United States Patent [19]

Ikeda et al.

[11] Patent Number: 4,863,356

[45] Date of Patent: Sep. 5, 1989

[54] MULTI-CYLINDER REFRIGERANT GAS COMPRESSOR WITH A MUFFLING ARRANGEMENT

[75] Inventors: Hayato Ikeda; Tatsuyuki Hoshino; Masahiro Sawada, all of Kariya, Japan

[73] Assignee: Kabushiki Kaisha Toyoda Jidoshokki Seisakusho, Aichi, Japan

[21] Appl. No.: 166,442

[22] Filed: Mar. 9, 1988

[30] Foreign Application Priority Data

Mar. 11, 1987 [JP] Japan ..... 62-036112[U]

[51] Int. Cl.[4] ..... F04B 1/16; F04B 39/00; F01N 7/00

[52] U.S. Cl. ..... 417/269; 417/312; 417/313; 181/238; 181/403

[58] Field of Search ..... 417/312, 313, 269; 181/238, 403

[56] References Cited

U.S. PATENT DOCUMENTS

| | | | |
|---|---|---|---|
| Re. 31,989 | 9/1985 | Nomura | 181/238 |
| 4,327,811 | 5/1982 | Isaka | 181/238 |
| 4,570,745 | 2/1985 | Sparks | 181/206 |
| 4,616,604 | 9/1986 | Iwamoti | 417/312 |

FOREIGN PATENT DOCUMENTS

| | | | |
|---|---|---|---|
| 27113 | 3/1978 | Japan | 417/312 |

*Primary Examiner*—William L. Freeh

*Attorney, Agent, or Firm*—Burgess, Ryan & Wayne

[57] ABSTRACT

A multi-cylinder piston-operated compressor having a combined cylinder block closed on both axial ends by front and rear housing and provided therein with a reciprocative piston mechanism, for sucking, compressing, and discharging a refrigerant gas, and a connecting flange, from which the refrigerant gas after compression is sent toward a cooling circuit. The connecting flange defines a muffling chamber in cooperation with a circumferential section of the combined cylinder block for suppressing the pulsation in discharge pressure of the refrigerant gas. The compressor further has a gas expansion chamber in which an expansion and a partial collision of the compressed refrigerant gas spouted from orifices take plate to weaken the pulsation in the discharge pressure of the gas with the least discharge loss.

6 Claims, 3 Drawing Sheets

MULTI-CYLINDER REFRIGERANT GAS COMPRESSOR WITH A MUFFLING ARRANGEMENT

BACKGROUND OF THE INVENTION

1. Field of the Invention

The present invention relates to a multi-cylinder refrigerant gas compressor preferably adapted for use in an automobile air-conditioning system, more specifically, it relates to a swash plate type compressor with a muffling arrangement for suppressing discharge pressure pulsation in a refrigerant gas after compression.

2. Description of the Related Art

In a multi-cylinder refrigerant gas compressor for use in an automobile air-conditioning system, refrigerant gas returning from the air-conditioning system is pumped into and compressed by a multi-cylinder compressing system having pistons operated by an actuator, such as a rotary swash plate. The refrigerant gas, when compressed, is discharged from the cylinder bores into discharge chambers provided axially at front and/or rear sides of a cylinder block unit of the compressor. The compressed refrigerant gas is then passed through discharge passageways of the cylinder block unit and the separate flows of the gas collected together. Subsequently, the collected refrigerant gas is sent through a connecting flange element toward a cooling circuit of the air-conditioning system.

During the above-mentioned compressing and discharging of the refrigerant gas, pulsation occurs in the discharge pressure of the gas due to the reciprocating motion of the pistons, the frequency of the pulsation depending on the number of cylinder bores, and this pulsation must be suppressed to prevent noise and vibration problems. Accordingly, a muffling chamber has conventionally been provided in the refrigerant-gas delivery circuit for reducing the pulsation in the discharge pressure of the refrigerant gas.

U.S. Pat. No. 4,610,604 to Iwamori discloses a multi-cylinder swash plate type compressor having a connecting flange which defines therein a muffling chamber and a collision zone. In the compressor, the refrigerant gas compressed by the swash-plate operated piston mechanism is delivered from a front and a rear discharge chamber as a pair of opposed streams of the compressed refrigerant gas into the collision zone, wherein the opposed streams of refrigerant gas are allowed to directly collide to thereby weaken the pulsation in the discharge pressure of the compressed refrigerant gas. The refrigerant gas is then sent to the muffling chamber to completely suppress the pulsation, and subsequently delivered to the cooling circuit via the connecting flange. However, in the collision zone of the compressor of U.S. Pat. No. 4,610,604, since the opposed streams of the compressed gas are delivered from a pair of coaxially opposed orifices into the collision zone, one of the opposed streams of the compressed refrigerant gas tends to prevent a smooth delivery of the other of the opposed streams of the compressed refrigerant gas from the corresponding orifice. That is, one of the opposed streams of the compressed gas exerts a resistance to the other stream, and therefore, a loss of delivery of the compressed refrigerant gas occurs while the compressed gas flows through the collision zone. The loss of delivery of the compressed refrigerant gas is relatively small in the low and medium rotation speed ranges of the compressor, but becomes large in the high rotation speed range of the compressor, and thus causes noise.

SUMMARY OF THE INVENTION

An object of the present invention is to obviate the above-mentioned defect encountered by the muffling arrangement of the conventional multi-cylinder refrigerant compressor.

Another object of the present invention is to provide a multi-cylinder swash plate type compressor, having a muffling arrangement capable of suppressing the pulsation in the discharge pressure of the compressed refrigerant gas over the entire range of rotation speeds of the compressor.

A further object of the present invention is to provide a multi-cylinder swash plate type compressor capable of maintaining a quiet operation regardless of changes in the rotation speed thereof, i.e., from a low speed to a high speed.

In accordance with the present invention, there is provided a multi-cylinder swash plate type compressor for compressing a refrigerant gas of a cooling circuit, which includes a cylinder block means having therein a swash-plate operated reciprocative piston mechanism for sucking, compressing, and discharging a refrigerant gas and delivery passage means for delivering the refrigerant gas after compression; housing means arranged so as to close axial ends of the cylinder block means and having therein suction and discharge chambers in communication with the reciprocative pistons mechanism; wall means extending from the cylinder block means, for defining therein a gas expansion zone and a large volume muffling chamber for receiving the refrigerant gas after compression, when delivered from the gas expansion zone, the gas expansion zone being in gas flow communication with the muffling chamber, for causing a volumetric expansion of a pair of opposed streams of the compressed refrigerant gas before the compressed refrigerant gas enters the muffling chamber, the gas expansion zone further being in flow communication with the delivery passage means; connecting flange means mounted on the wall means, for closing the muffling chamber and sending the compressed refrigerant gas from the muffling chamber to the cooling circuit. The wall means is characterized by comprising a pair of opposed partition walls arranged between the delivery passage means and the gas expansion zone, and at least a pair of opposed orifice means opening toward the gas expansion zone, for allowing the pair of opposed streams of the compressed refrigerant gas delivered from the delivery passage means to enter the gas expansion zone, the pair of orifice means having axes out of registration with one another, to thereby cause a partial collision of the pair of opposed streams of the compressed refrigerant gas within the gas expansion zone.

Preferably, the cylinder block means has a pair of axially aligned cylinder blocks, one being axially longer than the other and being formed with the wall means extended vertically to an aligned axis of the pair of cylinder blocks.

BRIEF DESCRIPTION OF THE DRAWINGS

The present invention will be more apparent from the ensuing description of embodiments with reference to the accompanying drawings, wherein.

DESCRIPTION OF THE PREFERRED EMBODIMENT

Figure 1:
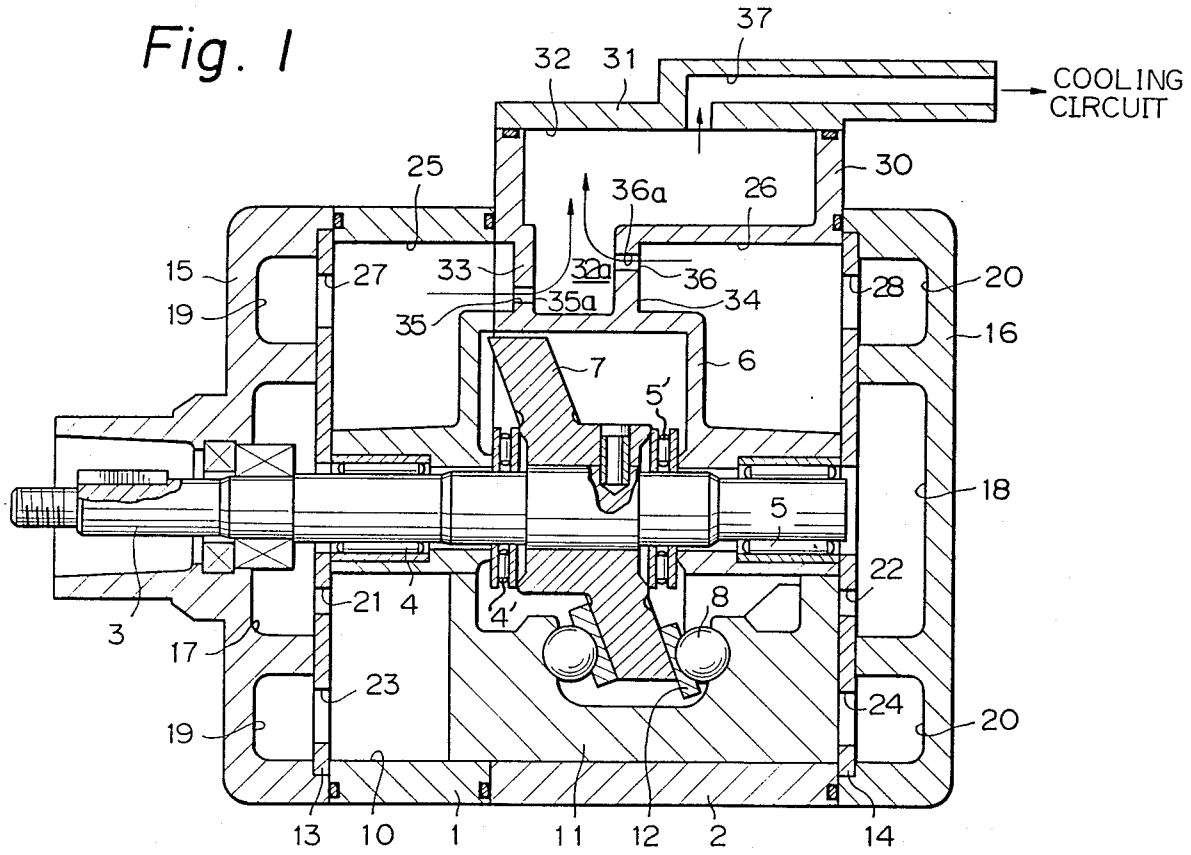
FIG. 1 is a longitudinal cross-sectional view of a multi-cylinder swash plate type compressor according to an embodiment of the present invention.

Referring to FIG. 1, the multi-cylinder swash plate type compressor has front and rear cylinder blocks 1 and 2 combined with one another in axial alignment. The plane of junction of the two cylinder blocks 1 and 2 is displaced away from the center of the combined cylinder blocks 1 and 2 toward the front cylinder block 1. That is, the rear cylinder block 2 is axially longer than the front cylinder block 1. The compressor also has an axial drive shaft 3 centrally rotatably supported by the combined cylinder blocks 1 and 2 via radial bearings 4 and 5. The drive shaft 3 has a swash plate 7 fixed thereto and rotated within a swash plate chamber 6 arranged in the central portion of the combined cylinder blocks 1 and 2. The combined cylinder blocks 1 and 2 are provided with an appropriate number of axially extending cylinder bores 10 arranged in parallel with one another and with the above-mentioned drive shaft 3. Within the cylinder bores 10 are disposed a number of double-headed pistons 11 reciprocated by the rotation of the swash plate 7 via ball bearings 8 and shoes 12. The swash plate 7 rotating with the drive shaft 3 is axially supported by thrust bearings 4' and 5'.

Front and rear ends of the combined cylinder blocks are fluid-tightly closed by front and rear housings 15 and 16, respectively, via front and rear valve plates 13 and 14. The front and rear housings 15 and 16 are formed with inner suction chambers 17 and 18 and outer annular discharge chambers 19 and 20, respectively. The suction chambers 17 and 18 of the front and rear housings 15 and 16 are respectively communicated with the cylinder bores 10 by way of suction ports 21 and 22 bored in the front and rear valve plates 13 and 14. The discharge chambers 19 and 20 of the front and rear housings 15 and 16 are respectively communicated with the cylinder bores 10 by way of discharge ports 23 and 24 bored in the front and rear valve plates 13 and 14. The suction ports 21 and 22 and the discharge ports 23 and 24 are openably closed by conventional reed valves (not illustrated in FIG. 1). The combined cylinder blocks 1 and 2 have discharge passageways 25 and 26 formed therein which are communicated with the discharge chambers 19 and 20 of the front and rear housings 15 and 16 by way of communicating bores 27 and 28 formed in the front and rear valve plates 13 and 14. The discharge passageway 25 is arranged in the front cylinder block 1 in the form of a radially and axially extending cavity enclosed by the front side wall of the swash plate chamber 6 and a radial partition wall 33 extending vertically to the axis of the combined cylinder blocks 1 and 2. The discharge passageway 26 is arranged in the rear cylinder block 2 in the form of a radially and axially extending cavity enclosed by the rear side wall of the swash plate chamber 6 and a radial partition wall 34 extending vertically to the axis of the combined cylinder blocks 1 and 2. The radial partition walls 33 and 34 are axially opposed to one another and define therebetween a later-described gas expansion chamber 32*a*.

A wall 30 is projected outward from the outer circumference of one of the combined cylinder blocks 1 and 2, i.e., the longer rear cylinder block 2 in the case of the present embodiment, so as to enclose an open chamber having a substantial volume. The wall 30 is formed integrally with the rear cylinder block 2 and is located adjacent to the discharge passageway 26. A connecting flange 31 which closes the open chamber of the wall 30 to define a closed muffling chamber 32 is sealingly mounted on top of the wall 30. The muffling chamber 32 is in fluid communication with the gas expansion chamber 32*a* located therebeneath, and the muffling chamber 32 and the gas expansion chamber 32*a* are in fluid communication with the delivery passageways 25 and 26 by way of orifices 35 and 36 formed in the partition walls 33 and 34, and therefore, receive the refrigerant gas after compression discharged from the delivery passageways 25 and 26. It should be noted that, although the orifice 35 of the partition wall 33 having an outlet end 35*a*, and the orifice 36 of the partition wall 34 having an outlet end 36*a*, are axially opposed, the two orifices 35 and 36 are shifted radially from one another with respect to the axis of the combined cylinder blocks 1 and 2. That is, these orifices 35 and 36 are out of registration with one another so that a direct collision of the refrigerant gas delivered from both orifices 35 and 36 is intentionally avoided. Therefore, the outlet end 35*a* of the orifice 35 is not coaxial with the outlet end 36*a* of the orifice 36. The orifices 35 and 36 operate to choke the streams of the refrigerant gas passing therethrough before entering the gas expansion and muffling chambers 32*a* and 32. A narrow outlet passageway 37 is arranged to deliver the compressed gas from the muffling chamber 32 toward the cooling circuit.

Although not illustrated in FIG. 1, a suction port for introducing the refrigerant gas returning from the cooling circuit of the air-conditioning system into the suction chambers 17 and 18 of the compressor, is arranged in, e.g., a part of the wall 30.

In the above-described structure of the swash plate type compressor, the operations of the compressor, i.e., pumping-in, compressing, and discharging of the refrigerant gas, are conducted by the rotation of the drive shaft 3. The drive shaft 3 is rotated from the outside, for example, by an automobile engine system. The rotation of the drive shaft 3 together with the swash plate 7 causes a reciprocative motion of the pistons 11 in the cylinder bores 10, and thus the refrigerant gas returning from the cooling circuit is eventually drawn into the cylinder bores 10 by way of the suction port, the front and rear suction chambers 17 and 18, and the front and rear suction ports 21 and 22. The refrigerant gas is then compressed by the reciprocating pistons 11.

The compressed refrigerant gas under a high pressure is discharged from the cylinder bores 10 to the discharge chambers 19 and 20 through the discharge ports 23 and 24 of the front and rear valve plates 13 and 14. The refrigerant gas in both discharge chambers 19 and 20 then flows through the delivery passageways 25 and 26 and through the orifices 35 and 36 toward the gas expansion chamber 32*a*. While the refrigerant gas is passing through the orifices 35 and 36, the pressure of the refrigerant gas is increased by the choking action of these orifices 35 and 36, and refrigerant gas under a high pressure is then delivered from the outlet ends 35*a* and 36*a* of both orifices 35 and 36 into the gas expansion chamber 32*a*, wherein it is subjected to volumetric expansion. At this stage, since the refrigerant gas is delivered from the orifices 35 and 36 in the form of a pair of opposed streams of gas, the opposed streams of gas collide with one another. However, due to the non-coaxial arrangement of the outlet ends 35*a* and 36*a* of the two orifices 35 and 36, the opposed streams of gas undergo only a partial collision during the expansion process, and therefore, the pulsation in the discharge pressure of the refrigerant gas is effectively suppressed and weakened. Moreover, the above-mentioned partial collision of the opposed refrigerant gas streams prevents one of the opposed streams from being blocked by the other stream. That is, the opposed refrigerant gas streams do not exert resistance against one another. Accordingly, there is no appreciable loss of delivery of the refrigerant gas after compression even when the refrigerant gas is delivered from the orifices 35 and 36 into the gas expansion chamber 32*a* during a high speed rotation of the compressor, and as a result, noise due to the loss of delivery of the compressed refrigerant gas is eliminated.

The refrigerant gas passing through the gas expansion chamber 32*a* enters the muffling chamber 32 in which the gas is subjected to a further noise muffling effect. The muffled refrigerant gas is then delivered through the narrow outlet passageway 37 toward the cooling circuit of the air-conditioning system.

Figure 2:
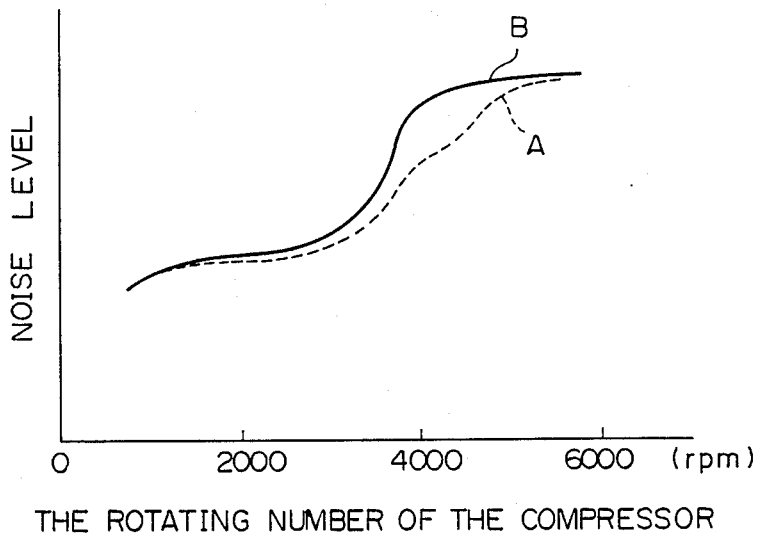
FIG. 2 is a graphical view illustrating a change in a noise level in response to a change in the rotation speed of the compressor, with respect to both the prior art and the present invention.

FIG. 2 illustrates the result of an experiment conducted by the present inventors when comparing the noise level of the multi-cylinder swash plate type compressor according to the embodiment of the present invention shown in FIG. 1, and that of the compressor according to the prior art. The abscissa of the graph of FIG. 2 indicates the rotation speed of the compressor, and the ordinate of the graph indicates the noise level. The curve designated by "A" is the case of the present invention, and curve "B" is the case of the prior art. From the comparison of the two curves "A" and "B", it is easily understood that a reduction in the noise level can be achieved by the present invention at a high rotation speed range of the compressor of from 3,500 r.p.m through 5,000 r.p.m.

Figure 3:
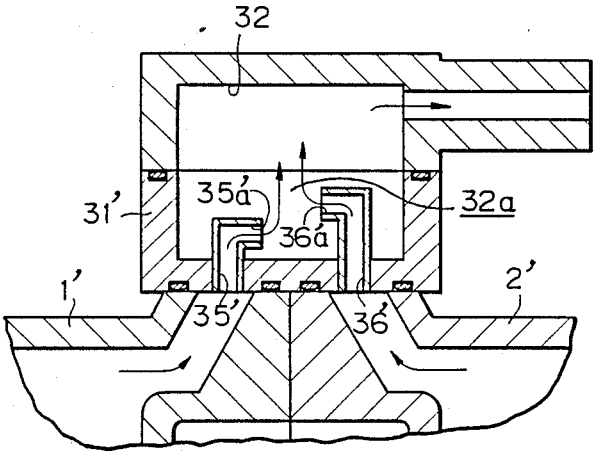
FIG. 3 is a partial cross-sectional view of an expansion and muffling arrangement, illustrating another embodiment of the present invention.

FIG. 3 illustrates another embodiment in which the plane of the junction of the two cylinder blocks 1' and 2' is located at the center of the combined cylinder blocks 1' and 2', and a connecting flange 31' is mounted on the combined cylinder blocks 1' and 2' at the junction of the two cylinder blocks 1' and 2'. The connecting flange 31' is provided therein with an upper muffling chamber 32 and a lower gas expansion chamber 32*a* in which two crank-shape pipes are arranged so as to form a pair of crank-shape orifices 35' and 36' having outlet ends 35*a'* and 36*a'*, respectively. It should be noted that the outlet ends 35*a'* and 36*a'* are out of registration with one another with respect to the radial direction of the combined cylinder blocks 1' and 2'. That is, a coaxial arrangement of the outlet ends 35*a'* and 36*a'* from which a pair of opposed streams of the compressed refrigerant gas are delivered is not adopted. Therefore, the same noise suppression effect as realized by the afore-mentioned embodiment of the present invention is achieved by the embodiment of FIG. 3 without causing a loss of delivery of the compressed refrigerant gas in the high speed rotation range of the compressor. Further, since the connecting flange 31' is formed as a separate element, and is attached to the combined cylinder blocks 1' and 2', the present embodiment can be easily applied to existing conventional multi-cylinder swash plate type compressors by a simple modification.

Figure 4:
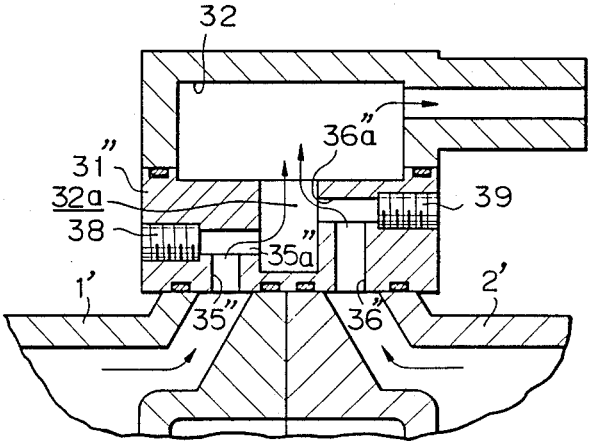
FIG. 4 is a partial cross-sectional view of an expansion and muffling arrangement, illustrating further embodiment of the present invention.

FIG. 4 illustrates a further embodiment in which a bottom portion of a connecting flange 31'' having an upper muffling chamber 32 and a lower gas expansion chamber 32*a* is provided with machined orifices 35'' and 36'' plugged at the outer ends thereof by screw plugs 38 and 39. These orifices 35'' and 36'' form a pair of mutually shifted outlet ends 35*a''* and 36*a''* through which a pair of opposed streams of the compressed refrigerant gas enter the gas expansion chamber 32*a* while causing a partial collision of the gas. The present embodiment of FIG. 4 has the same operational effect as the former two embodiments.

From the foregoing description of the embodiments of the present invention, it will be understood that, according to the present invention, there is provided a multi-cylinder refrigerant gas compressor with a muffling arrangement in which the refrigerant gas after compression undergoes only a partial collision for weakening the pulsation in discharge pressure of the refrigerant gas, in addition to choking and volumetric expansion. Therefore, the loss of delivery of the refrigerant gas after compression can be controlled in a high speed rotation range of the compressor, and thus an appreciable reduction in the noise level of the multi-cylinder refrigerant gas compressor can be achieved. Also, the pulsation in the discharge pressure of the refrigerant gas after compression can be effectively suppressed.

It should be understood that modifications and variations of the present invention, within the spirit and scope of the appended claims, will occur to those skilled in the art. For example, the non-coaxial arrangement of the orifices in the gas expansion chamber may be accomplished by shifting the orifices in the circumferential direction of the combined cylinder blocks instead of the illustrated radial shifting arrangement.

We claim:

1. In a multi-cylinder swash plate type compressor adapted for use in compressing a refrigerant gas of a cooling circuit, including:

cylinder block means having therein a swash-plate operated reciprocative piston mechanism for sucking, compressing, and discharging a refrigerant gas and delivery passage means for delivering the refrigerant gas after compression, housing means arranged so as to close axial ends of the cylinder block means and having therein suction and discharge chambers in communication with the reciprocative pistons mechanism;

wall means extending from said cylinder block means, for defining therein a gas expansion zone and a large volume of muffling chamber for receiving the refrigerant gas after compression, delivered from said gas expansion zone, said gas expansion zone being in gas flow communication with said muffling chamber, for causing volumetric expansion of a pair of opposed streams of said compressed refrigerant gas before said compressed refrigerant gas enters said muffling chamber, said gas expansion zone further being in flow communication with said delivery passage means;

connecting flange means mounted on said wall means, for closing said muffling chamber and sending out the compressed refrigerant gas from said muffling chamber to the cooling circuit, the improvement wherein said wall means comprise a pair of opposed partition walls arranged between said delivery passage means and said gas expansion zone, and at least a pair of opposed orifice means opening toward said gas expansion zone, for allowing said pair of opposed streams of said compressed refrigerant gas delivered from said delivery passage means to enter said gas expansion zone, said pair of orifice means having axes being out of registration with one another such that only a partial collision of said pair of opposed streams of said compressed refrigerant gas within said gas expansion occurs zone.

2. A multi-cylinder swash plate type compressor according to claim 1, wherein said pair of opposed orifice means comprise a pair of mutually opposed narrow holes formed in said partition walls, said pair of mutually opposed narrow holes formed in said partition walls having axes being out of registration with one another.

3. A multi-cylinder swash plate type compressor according to claim 1, wherein said cylinder block means comprises a pair of axially aligned cylinder blocks, one having an axial length longer than that of the other and being formed with said wall means extending perpendicularly to an aligned axis of said cylinder blocks.

4. A multi-cylinder swash plate type compressor according to claim 1, wherein said wall means extending from said cylinder block means comprises a box-like element attached to said cylinder block means in a sealing manner and having an upstanding enclosure wall closed by said connecting flange means, and wherein said pair of opposed orifice means comprise a pair of opposed pipes mounted in said box-like element, said pair of opposed pipes having gas outlets opposed to one another in non-coaxial relationship with-in said gas expansion zone and gas inlets in gas flow communication with said delivery passage means to introduce said pair of opposed streams of said refrigerant gas.

5. A multi-cylinder swash plate type compressor according to claim 1, wherein said wall means extending from said cylinder block means comprises a box-like element attached to said cylinder block means in a sealing manner and having an open mouth enclosed by an upstanding wall and closed by said connecting flange means, and wherein said pair of opposed orifice means comprise a pair of crank-shape bores formed by machining in said box-like element, said crank-like bores having gas outlets opposed to one another in non-coaxial relationship within said gas expansion zone and gas inlets in gas flow communication with said delivery passage means to introduce said pair of opposed streams of said refrigerant gas.

6. A multi-cylinder compressor adapted for use in compressing a refrigerant gas of an air-conditioning system of a vehicle comprising:

cylinder block means having therein a swash-plate-operated reciprocative piston mechanism for pumping-in, compressing, and discharging a refrigerant gas and delivery passage means for delivering the refrigerant gas after compression;

an axial drive shaft rotatably arranged in said cylinder block means and mounting thereon a swash plate for driving said reciprocative piston mechanism;

housing means having therein a discharge chamber into which the refrigerant gas is discharged from said reciprocative piston mechanism and a suction chamber from which the refrigerant gas is pumped in said reciprocative piston mechanism;

valve plate arranged between opposed ends of said cylinder block means and said housing means for defining therein inlet ports able to connect said suction chamber to said reciprocative piston mechanism and outlet ports able to connect said discharge chamber to said delivery passage means;

connecting flange means mounted on said cylinder block means for sending out the refrigerant gas after compression from said delivery passage means of said cylinder block means toward said air-conditioning system;

means for causing expansion and a partial collision of a pair of opposed streams of the refrigerant gas after compression delivered from said delivery passage means of said cylinder block means, thereby reducing the discharge pressure pulsation of said refrigerant gas after compression; and, muffling chamber means for receiving said refrigerant gas after compression from said means for causing expansion and a partial collision of a pair of opposed streams of the refrigerant gas after compression, prior to sending out said gas toward said air-conditioning system, thereby suppressing the discharge pressure pulsation of said gas before said refrigerant gas after compression is delivered to said air-conditioning system.

* * * * *